US012618292B2

(12) United States Patent
Trinh et al.

(10) Patent No.: US 12,618,292 B2
(45) Date of Patent: May 5, 2026

(54) ON DEMAND FLOW PULSING SYSTEM

(71) Applicant: National Oilwell Varco, L.P., Houston, TX (US)

(72) Inventors: Khoi Trinh, Spring, TX (US); Steve Bhagwandin, Houston, TX (US); Yufang Xia, Houston, TX (US); Ian Forster, The Woodlands, TX (US)

(73) Assignee: National Oilwell Varco, L.P., Houston, TX (US)

( * ) Notice: Subject to any disclaimer, the term of this patent is extended or adjusted under 35 U.S.C. 154(b) by 48 days.

(21) Appl. No.: 17/629,057

(22) PCT Filed: Jul. 21, 2020

(86) PCT No.: PCT/US2020/042943
§ 371 (c)(1),
(2) Date: Jan. 21, 2022

(87) PCT Pub. No.: WO2021/016282
PCT Pub. Date: Jan. 28, 2021

(65) Prior Publication Data

US 2022/0275685 A1 Sep. 1, 2022

Related U.S. Application Data

(60) Provisional application No. 62/877,168, filed on Jul. 22, 2019.

(51) Int. Cl.
*E21B 7/24* (2006.01)
*E21B 34/14* (2006.01)
*E21B 47/18* (2012.01)

(52) U.S. Cl.
CPC ..... *E21B 7/24* (2013.01); *E21B 34/142* (2020.05); *E21B 47/18* (2013.01)

(58) Field of Classification Search
CPC ..... E21B 7/24; E21B 34/142; E21B 47/18
See application file for complete search history.

(56) References Cited

U.S. PATENT DOCUMENTS 4,462,469 A * 7/1984 Brown ..... E21B 47/18 175/93
6,279,670 B1 * 8/2001 Eddison ..... E21B 4/02 175/107

(Continued)

FOREIGN PATENT DOCUMENTS

WO 2011/058307 A2 5/2011
WO 2015/081432 A1 6/2015
WO 2018183499 A1 10/2018

OTHER PUBLICATIONS

International Search Report and Written Opinion dated Oct. 1, 2020, for Application No. PCT/US2020/042943.

(Continued)

*Primary Examiner* — Blake Michener
(74) *Attorney, Agent, or Firm* — Conley Rose, P.C.

(57) ABSTRACT

Embodiments disclosed herein are directed to a flow pulsing system including a rotor, a stator, a dart which is configured to releasably couple with the rotor, and a nozzle releasably coupled to the rotor which is configured to control a fluid flow through the rotor. In some embodiments, the system uses a screen disposed therein which includes an inner bore in fluid communication with a plurality of lobe cavities along the rotor. In some embodiments, the system uses a stationary valve and an oscillating valve having a plurality of oscillating valve ports which are in fluid communication with the plurality of lobe cavities.

17 Claims, 11 Drawing Sheets

(56) References Cited

U.S. PATENT DOCUMENTS

| | | | | |
|---|---|---|---|---|
| 8,167,051 | B2 | 5/2012 | Eddison et al. | |
| 9,004,194 | B2 * | 4/2015 | Eddison | E21B 7/24 175/107 |
| 9,637,991 | B2 * | 5/2017 | Eddison | E21B 28/00 |
| 2001/0054515 | A1 * | 12/2001 | Eddison | E21B 7/24 175/57 |
| 2009/0139769 | A1 * | 6/2009 | Traylor | E21B 4/02 175/57 |
| 2014/0102804 | A1 | 4/2014 | Cote | |
| 2014/0190749 | A1 | 7/2014 | Lorenson | |
| 2015/0075867 | A1 | 3/2015 | Eddison et al. | |
| 2016/0281449 | A1 * | 9/2016 | Lorenson | E21B 21/10 |
| 2019/0024459 | A1 * | 1/2019 | Sicilian | E21B 6/04 |
| 2019/0153820 | A1 | 5/2019 | Lorenson et al. | |

OTHER PUBLICATIONS

Extended European Search Report dated Oct. 1, 2024, for Application No. 24192982.7.

* cited by examiner

ON DEMAND FLOW PULSING SYSTEM

CROSS-REFERENCE TO RELATED APPLICATIONS

This application is a 35 U.S.C. § 371 national stage application of PCT/US2020/042943 filed Jul. 21, 2020, and entitled "On Demand Flow Pulsing System", which claims benefit of U.S. provisional patent application Ser. No. 62/877,168 filed Jul. 22, 2019 and entitled "On Demand Flow Pulsing System," both of which are hereby incorporated herein by reference in their entirety.

STATEMENT REGARDING FEDERALLY SPONSORED RESEARCH OR DEVELOPMENT

Not applicable.

BACKGROUND

The disclosure relates generally to downhole apparatus. More particularly, the disclosure relates to drilling apparatus and drilling methods which include an agitator or flow pulsing apparatus in a drill string. Among other benefits, a flow pulsing apparatus may be used to oscillate a drill string to reduce friction with a borehole, to enhance tool face control, to extend borehole lengths, and to improve drilling efficiency. The flow pulsing apparatus may be used in other downhole work strings as well.

BRIEF SUMMARY

Some embodiments disclosed herein are directed to a flow pulsing system. In an embodiment, the flow pulsing system includes a housing having a central axis, a first end, a second end opposite the first end, and a bore extending along the central axis from the first end to the second end. Additionally, some embodiments may include a stator disposed within the bore of the housing having a plurality of lobe cavities and a rotor disposed within the stator. The rotor includes an axis offset from the central axis, a plurality of lobes that mate with the plurality of lobe cavities, and a thru bore extending along the axis. Additionally, some embodiments may include a dart configured to releasably couple with the thru bore of the rotor, the dart including a first radially outer guide section, a second radially outer guide section, a tip, an inner bore, and a releasable nozzle configured to control a first fluid flow through the inner bore and the thru bore.

Other embodiments disclosed herein are directed to a flow pulsing system including a housing having a central axis, a first end, a second end opposite the first end, and a bore extending along the central axis from the first end to the second end. Additionally, some embodiments may include a stator disposed within the bore of the housing having a plurality of lobe cavities and a rotor disposed within the stator. The rotor includes an axis offset from the central axis, a plurality of lobes that correspond with the plurality of lobe cavities, a thru bore extending along the axis. Additionally, some embodiments may include a screen disposed within the bore of the housing, the screen including a body and a coupling surface at a first end of the body, the coupling surface configured to couple to the housing. Additionally, some embodiments may include a screen housing extending to a second end of the body and an inner bore to fluidly communicate with the thru bore.

Still other embodiments disclosed herein are directed to a flow pulsing system including a housing having a central axis, a first end, a second end opposite the first end, and a bore extending along the central axis from the first end to the second end. Additionally, some embodiments may include a stator disposed within the bore of the housing having a plurality of lobe cavities and a rotor disposed within the stator. The rotor includes an axis offset from the central axis, a plurality of lobes that mate with the plurality of lobe cavities, and a thru bore extending along the axis. Additionally, some embodiments may include a valve section including a stationary valve coupled to the second end of the housing, the stationary valve including a first face, a stationary central port, and a plurality of stationary valve ports. Additionally, some embodiments may include an oscillating valve coupled to the rotor, the oscillating valve including a second face abutting the first face, an oscillating central port in fluid communication with the thru bore of the rotor, and a plurality of oscillating valve ports in fluid communication with the plurality of lobe cavities.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
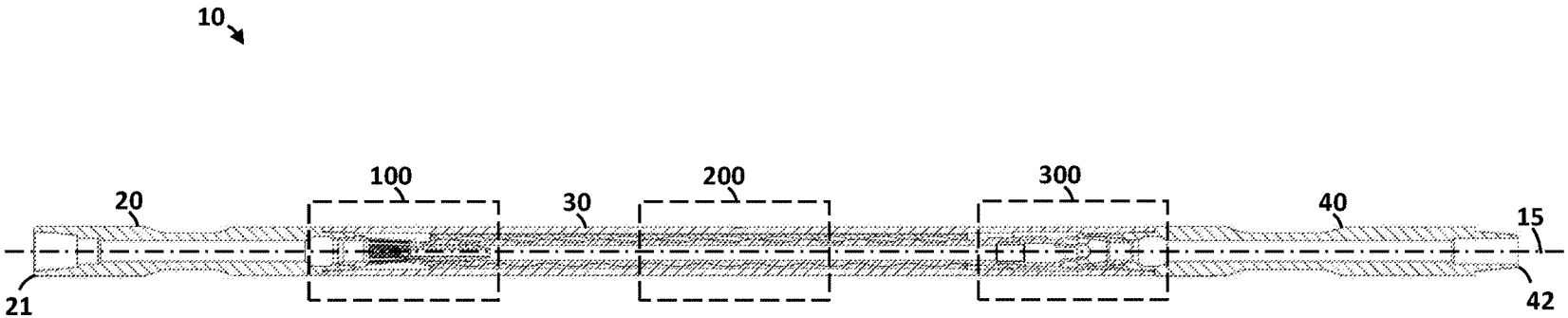
FIG. 1 is a cross-sectional view of a flow pulsing apparatus, according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As previously described above, a flow pulsing system, otherwise referred to herein as an agitator, may be used along a drill string to introduce a pressure pulse or pressure wave within a tubular of the drill string. A flow pulsing system may be used alone or with other components to provide drilling benefits including enhanced tool face control, improved drilling efficiency, and may be used to introduce oscillations of the drill string. More particularly, one such additional component used with the flow pulsing system, may be a shock tool, which harnesses the pressure pulses from the flow pulsing system to induce oscillations along the longitudinal axis of the drill string. In some applications, such drill string oscillations may provide reduced friction within a borehole and may allow for extended drill string lengths. To operate the flow pulsing system, pumping pressure is required from the drilling rig, to overcome pressure drops across the flow pulsing system, thus it may be desirable to provide a flow pulsing system which may be selectively activated only once the drill string encounters downhole conditions where it is needed. Additionally, it may also be desirable to operate the flow pulsing system at a frequency and magnitude which is adjustable, which then allows for less overall pressure drop. Further, it may also be desirable to have a flow pulsing system which may be deactivated when it is no longer needed or deactivated and reconfigured to provide a modified pressure pulse which is better suited for yet another section of wellbore drilling. In addition to drill strings, the flow pulsing apparatus can be used on other downhole work or tubular strings.

Accordingly, embodiments disclosed herein include systems and methods for using a flow pulsing system which may be selectively engaged after wellbore drilling has begun, and while the drill string is disposed within the wellbore. Additionally, embodiments disclosed herein include systems and methods to selectively adjust the frequency and magnitude of the flow pulsing system, as well as systems and methods to selectively disengage and/or reconfigure the frequency and magnitude of the flow pulsing system after its use within the wellbore. Further, systems and methods disclosed herein provide valve ports which may be operated between a fully open, a partially open, and a fully closed position which may provide an improved pressure pulse response. Still further, systems and methods disclosed herein resist clogging of the flow pulsing system when materials are introduced into the wellbore, such as loss circulation materials.

Referring to FIG. 1, a flow pulsing system 10 is shown coupled to a first sub 20 and a second sub 40, each aligned along axis 15. Flow pulsing system 10 includes a housing 30 and comprises an activation section 100, a rotor section 200, and a valve section 300. Generally speaking flow pulsing system 10 is a tubular assembly which may be installed along any segment of a drill string within a wellbore (not shown). Exemplary connections along a first end 21 of first sub 20 and a second end 42 of second sub 40 are shown, which may each be modified as necessary to adapt with a particular drill string. Similarly, second end 22 of first sub 20 (FIG. 9) and first end 41 of second sub 40 (FIG. 4) may also be modified as needed to adapt with housing 30 and flow pulsing system 10.

Figure 2:
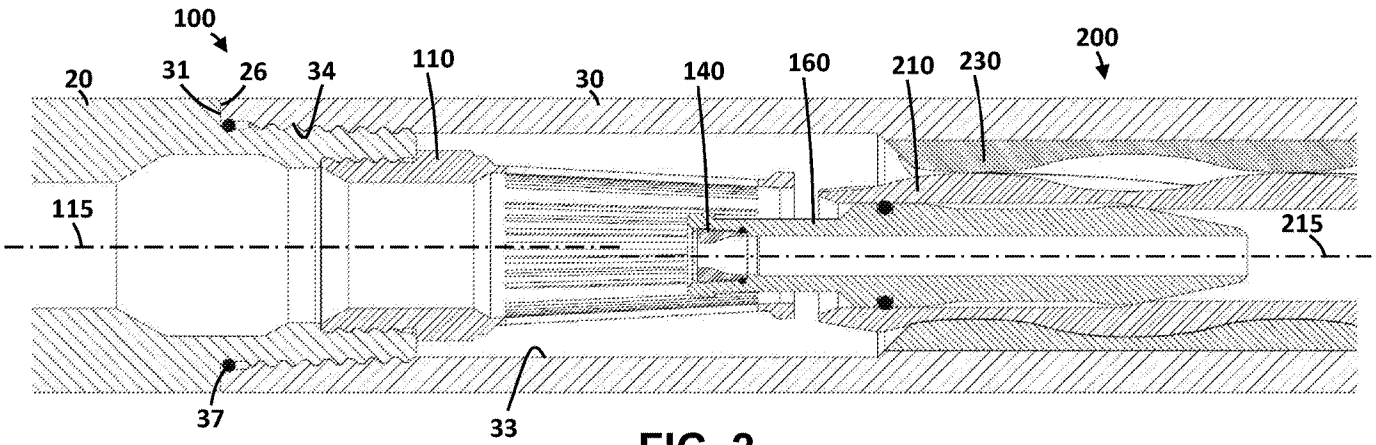
FIG. 2 is a cross-sectional view of an activation section and partial cross-sectional view of a rotor section of the flow pulsing apparatus of FIG. 1.

Referring to FIG. 2, activation section 100 is shown in more detail, which may be used within flow pulsing system 10. Activation section 100 comprises an axis 115 which is generally aligned with axis 15 of flow pulsing system 10, an axis 215 which is offset from axis 115, a screen 110, and a nozzle 140 installed within a dart 160. More particularly, housing 30 has a first end 31 and a second end 32 (shown in FIG. 4) opposite first end 31, and a bore 33 concentric with housing 30, which both extend along axis 115 between ends 31, 32. Screen 110 is positioned along axis 115 proximate first end 31, while nozzle 140 and dart 160 are positioned along axis 215 at a position between screen 110 and second end 32.

Figure 3:
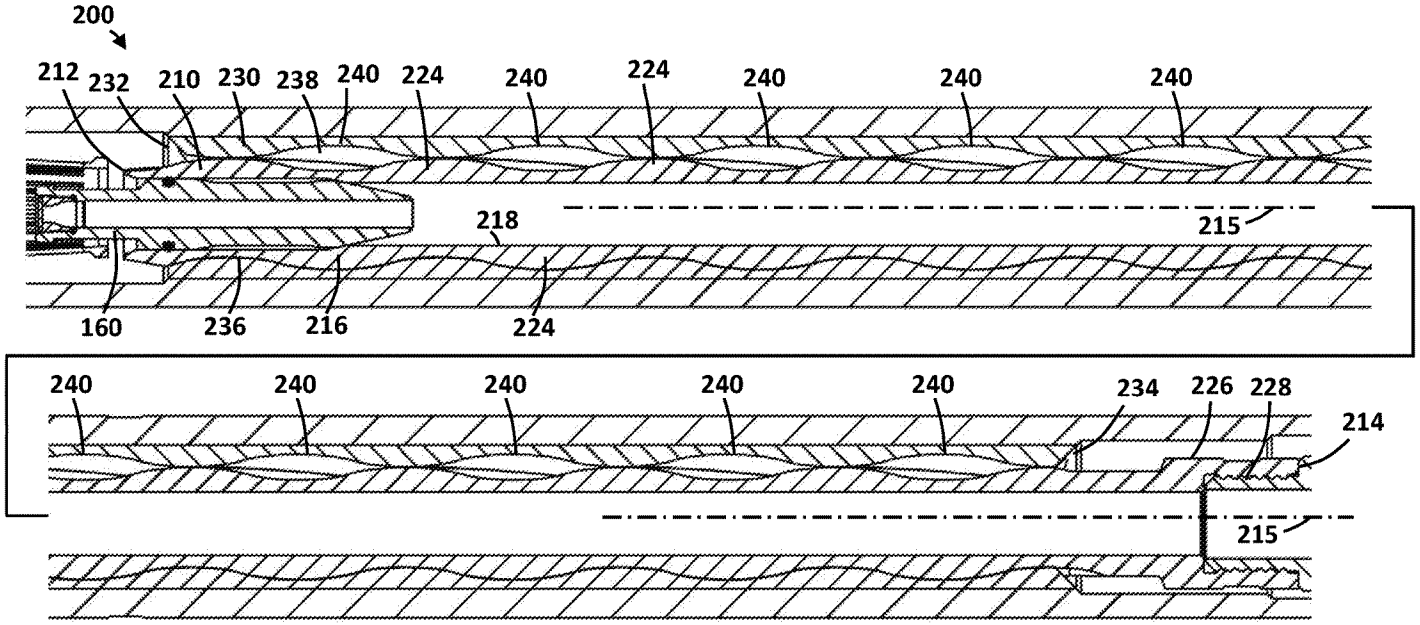
FIG. 3 is a cross-sectional view of the rotor section of the flow pulsing apparatus of FIG. 1.

Referring to FIGS. 2 and 3, rotor section 200 is shown in more detail, which comprises a rotor 210 aligned with axis 215 and a stator 230 aligned with axis 115. In general, rotor 210 and stator 230 are tubular members housed within bore 33 with rotor 210 positioned at least partially within stator 230. More particularly, stator 230 includes a first end 232 and a second end 234 opposite first end 232 and includes a radially inner surface 236 which extends between ends 232, 234. Stator 230 is coupled to housing 30 within bore 33 at a position between ends 31, 32 and comprises a plurality of lobe cavities 240 axially spaced apart along radially inner surface 236. The plurality of lobe cavities 240 results in the diameter of inner surface 236 sequentially expanding and contracting along the length of stator 230. Rotor 210 is also a tubular member comprising a first end 212, a second end 214 opposite first end 212, a body 216, and a bore 218. Body 216 and bore 218 are each aligned with axis 215, and extend between ends 212, 214. Rotor 210 further includes a lobe 224 extending radially outward from body 216, with lobe 224 arranged in a generally helical manner along axis 215 and extending between ends 212, 214. When viewed in cross-section as shown in FIGS. 2 and 3, the helical pitch is selected such that a full 360-degree revolution of lobe 224 about axis 215 coincides with the distance between lobe cavities 240. As described, a single continuous lobe 224 is shown in this embodiment, however other embodiments may use multiple lobes arranged helically or may use multiple separate lobes which are not formed helically. In some embodiments, rotor 210 may have one less lobe 224 than the quantity of lobe cavities 240 along stator 230. In all instances, lobes 224 may be referred to as separate lobes, when viewed in cross-section as a short hand for discussing the rotor 210 geometry. For example, in FIG. 3, rotor 210 includes eleven lobes 224. The relative dimensions of radially inner surface 236, lobe cavities 240, and lobe 224 are selected such that rotor 210 may be rotatably disposed within stator 230. The radial clearance between lobe 224 and lobe cavity 240 defines cavity 238.

Figure 4:
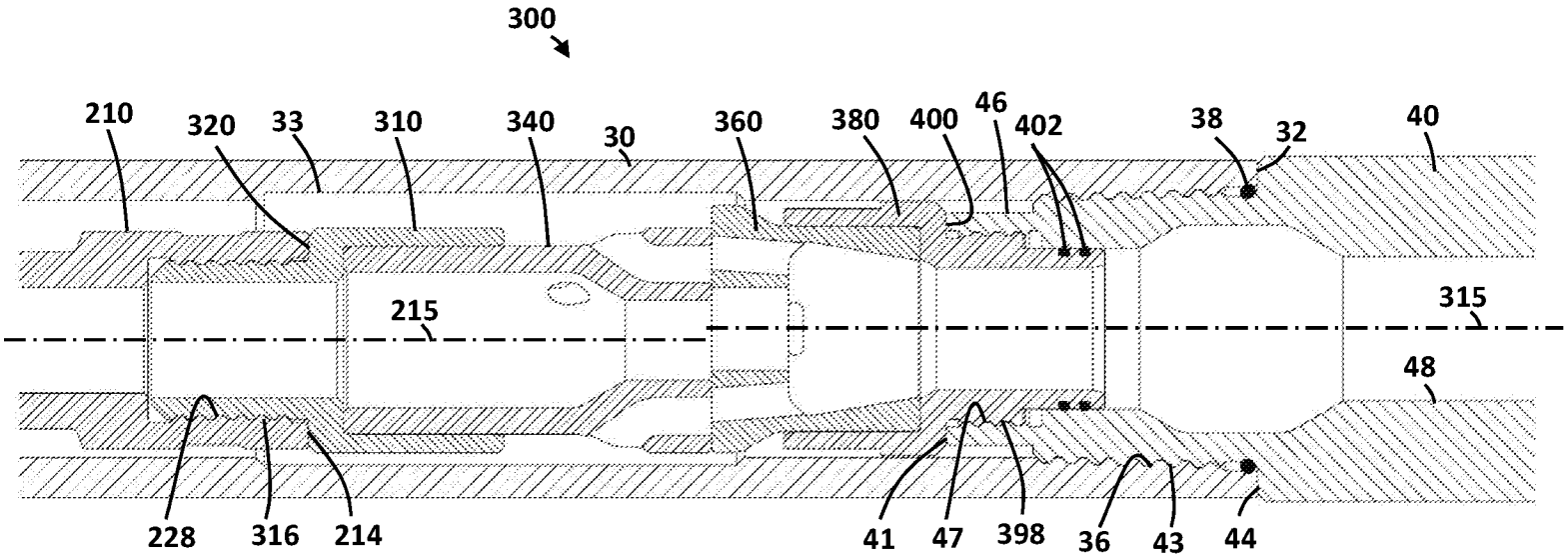
FIG. 4 is a cross-sectional view of a valve section of the flow pulsing apparatus of FIG. 1.

Referring to FIG. 4, valve section 300 is shown in more detail, which comprises components aligned with axis 215 of rotor 210 and components aligned with axis 315 which is generally aligned with axis 15 of flow pulsing system 10. In general, the components aligned with axis 215 are coupled to rotor 210 and thus move with rotor 210 within housing 30, while components aligned with axis 315 remain stationary relative to housing 30 and second sub 40. More particularly, valve section 300 components aligned with axis 215 comprise oscillating valve adapter 310 and oscillating valve port section 340. Additionally, valve section 300 components aligned with axis 315 comprise stationary valve port section 360 and stationary valve adapter 380.

Figure 5:
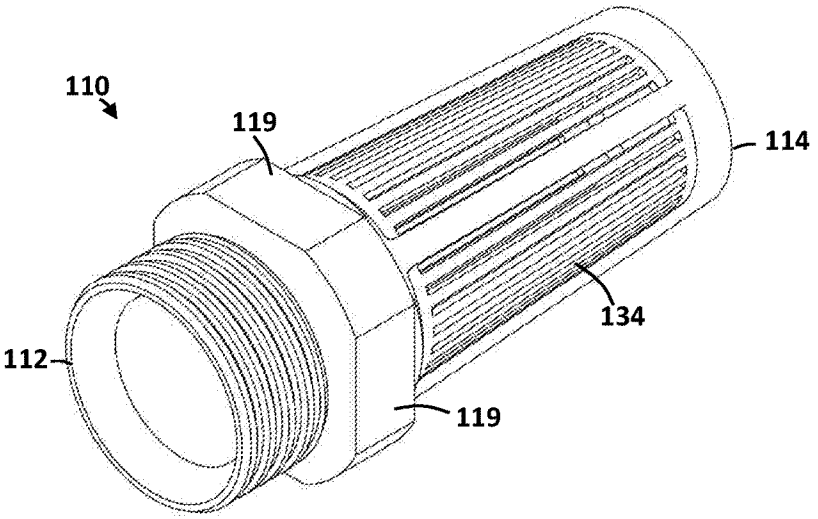
FIG. 5 is a perspective view of a screen used within the activation section of FIG. 2.
Figure 6:
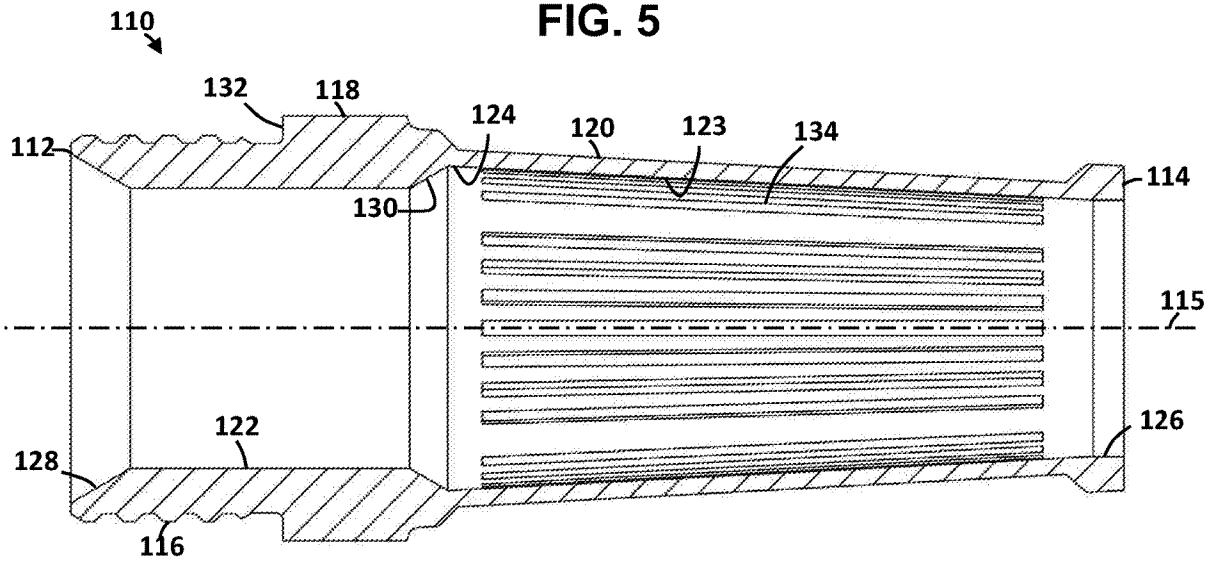
FIG. 6 is a cross-sectional view of the screen of FIG. 5.

Referring to FIGS. 5 and 6, screen 110 is shown in more detail and comprises axis 115, first end 112, and second end 114 opposite first end 112. Additionally, screen 110 comprises a coupling surface 116 extending along axis 115 from first end 112, a screen housing 120 extending along axis 115 from second end 114, and a body 118 extending therebetween. In some embodiments coupling surface 116 includes threads and has a smaller diameter than body 118, and annular shoulder 132 creates a radial transition therebetween. Also, flats 119 may be provided along body 118 to allow torque application to the threads of coupling surface 116. Bore 122 extends from first end 112, passing within coupling surface 116 and body 118, while inner surface 123 extends from second end 114 and passes within screen housing 120 to intersect bore 122. Chamfer 130 transitions between inner surface 123 and bore 122, while chamfer 128 is included along bore 122 at first end 112. Screen housing 120 and inner surface 123 are generally frustoconical in shape, having a larger inlet diameter 124 proximate first end 112 than an outlet diameter 126 at second end 114. Screen housing 120 additionally includes screen elements or slots 134 which pass through screen housing 120. In this embodiment, screen elements 134 include a plurality of elongated passages which are distributed circumferentially about axis 115, the elongated passages each having a long axis which is aligned with axis 115. However, other embodiments may include differently shaped passages within screen element 134 which are arranged differently. (e.g., for example a plurality of circular passages extending radially relative to axis 115).

Figure 7:
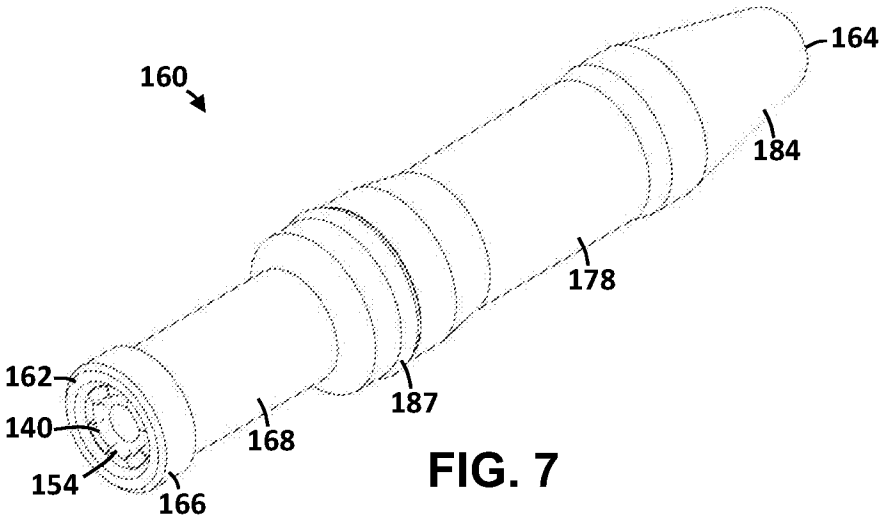
FIG. 7 is a perspective view of a dart and nozzle used within the activation section of FIG. 2.
Figure 8:
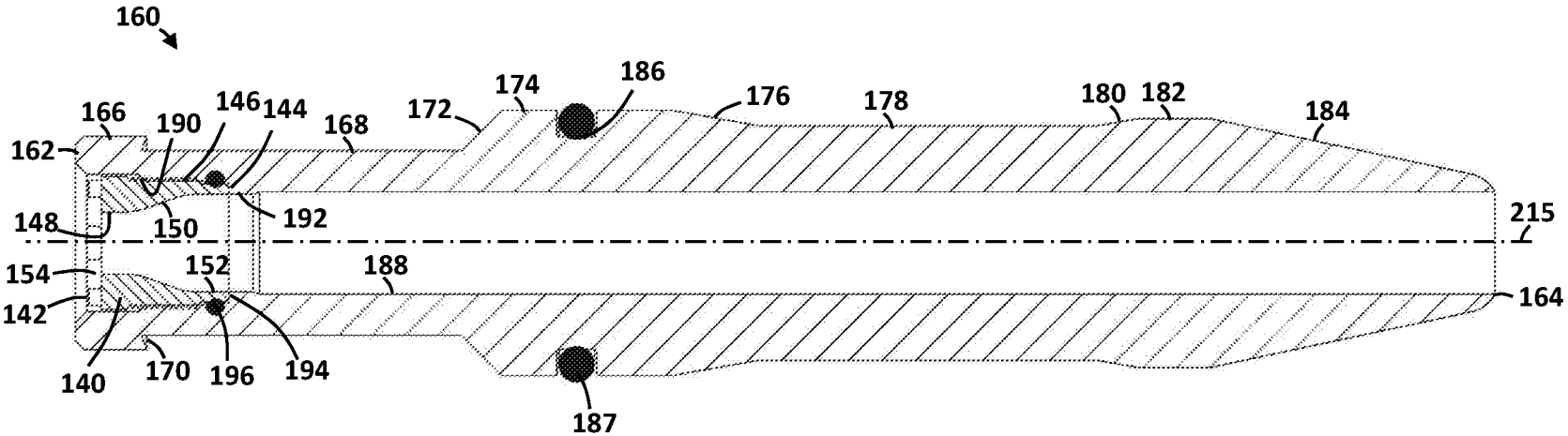
FIG. 8 is a cross-sectional view of the dart and a nozzle of FIG. 7.

Referring to FIGS. 7 and 8, dart 160 is shown in more detail and is generally symmetric relative to axis 215. More particularly, dart 160 comprises a first end 162, a second end 164 opposite first end 162, and a plurality of features extending axially along axis 215, including a head 166 extending from first end 162, a neck 168 extending from head 166, a first radially outer guide section 174 proximate neck 168, a second radially outer guide section 182 proximate second end 164, and a frustoconical tip 184 which narrows towards second end 164. In this embodiment, head 166 has a larger diameter than neck 168, and thus creates a shoulder 170 therebetween. Additionally, first radially outer guide section 174 and second radially outer guide section 182 have larger diameters than the surrounding sections of dart 160 and thus include various diameter transitions. More particularly, in this embodiment, chamfer type transitions are used and include transitions 172, 176, and 180. For reasons that will be more apparent in subsequent descriptions, first radially outer guide section 174 and second radially outer guide section 182 are spaced apart along axis 215 and a relief 178, having a reduced diameter, is provided therebetween. Additionally, first radially outer guide section 174 further includes a gland 186 disposed along its outer cylindrical surface and accepts a ring 187 (e.g. such as an O-ring) therein.

With respect to the inner surfaces of dart 160, dart 160 further comprises a bore 188 extending from second end 164 into neck 168, an inner coupling surface 190 extending from first end 162, and a second bore 192 extending therebetween. In this embodiment, inner coupling surface 190 is threaded and has a larger diameter than second bore 192, thus a shoulder 194 is formed therebetween.

Referring still to FIGS. 7 and 8, nozzle 140 is shown installed within the first end 162 of dart 160. More specifically, nozzle 140 is axially symmetric about axis 215 and comprises a first end 142, a second end 144 opposite first end 142, and an outer coupling surface 146 extending between ends 142, 144. Nozzle 140 further comprises drive 154 extending from first end 142 and an inner nozzle profile 150 which extends between ends 142, 144. More particularly, inner nozzle profile 150 includes an inlet 148 at first end 142 and an outlet 152 at second end 144. In this embodiment, inlet 148 has a smaller diameter than outlet 152 and thus may be considered a diffusing nozzle wherein a fluid passing from inlet 148 to outlet 152 would experience a decrease in flowrate and an associated increase in pressure. However, in other embodiments inlet 148 may be provided with an equal or larger diameter than outlet 152. The diameter of inlet 148, outlet 152, and the shape of inner nozzle profile 150 will be offered in various combinations and sizes, as the fluid flow through nozzle 140 will influence the flow within flow pulsing system 10 along various sections, as will be discussed more fully below.

When nozzle 140 is installed within dart 160, outer coupling surface 146 of nozzle 140 couples with inner coupling surface 190 of dart 160. Drive 154 may be used to apply torque to thread the segments together until second end 144 of nozzle 140 abuts with shoulder 194 of dart 160. Seals 196 (e.g., such as O-ring seals) may be provided along second end 144 to prevent fluid leakage around the perimeter of nozzle 140, and/or alternative seals 196 (not shown) may be provided along other sections of nozzle 140 as needed (e.g., proximate first end 142 of nozzle 140).

Figure 9:
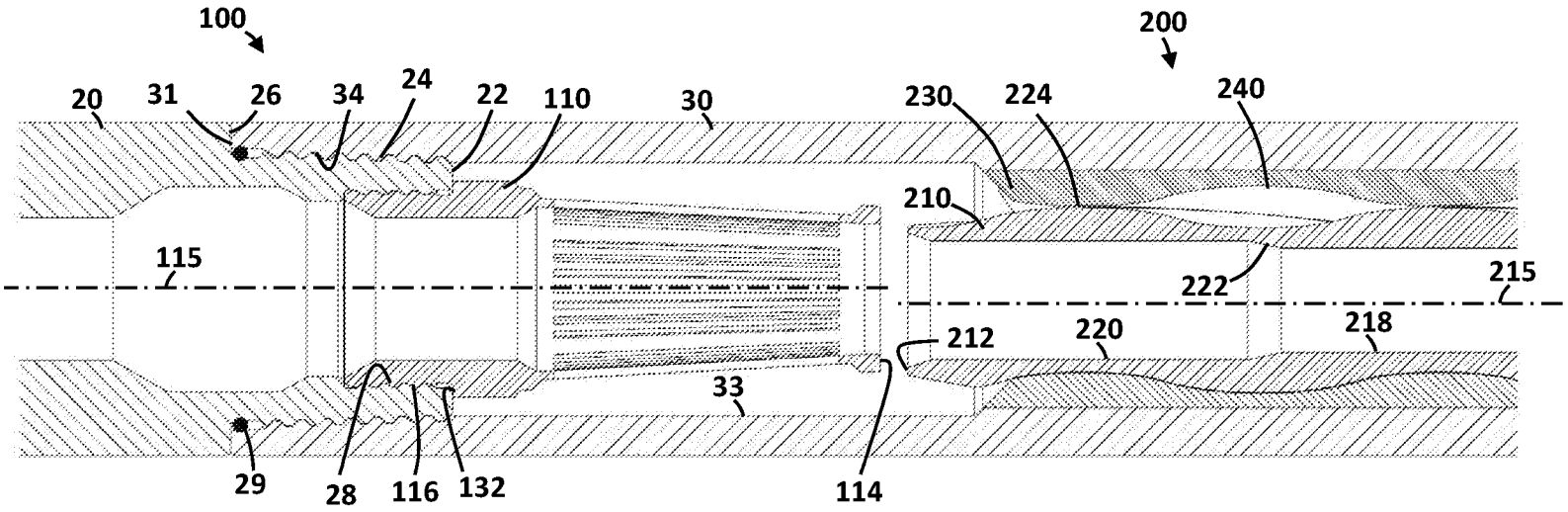
FIG. 9 is a cross-sectional view of the activation section and partial cross-sectional view of the rotor section in a deactivated condition.

Referring to FIG. 9, activation section 100 is shown in the deactivated condition or position, wherein dart 160 is not positioned within rotor 210. First sub 20 is shown coupled to housing 30 and to screen 110, with each aligned along axis 115. More particularly, first sub 20 includes an outer coupling surface 24 extending from second end 22, which couples with inner coupling surface 34 of housing 30. A shoulder 26 on first sub 20 abuts with first end 31 of housing 30 to limit the axial position therebetween, while a seal 29 provides bore sealing therebetween. First sub 20 further includes an inner coupling surface 28 which extends within first sub 20 from second end 22. Screen 110 couples with first sub 20 as coupling surface 116 engages inner coupling surface 28, and the axial position therebetween is established as annular shoulder 132 of screen 110 abuts second end 22 of first sub 20. As previously described, stator 230 is coupled within bore 33 of housing 30 at a fixed position, while rotor 210 is housed within stator 230. First end 212 of rotor 210 is placed proximate to second end 114 of screen 110 and in some instances makes abutting contact therewith.

Figure 10:
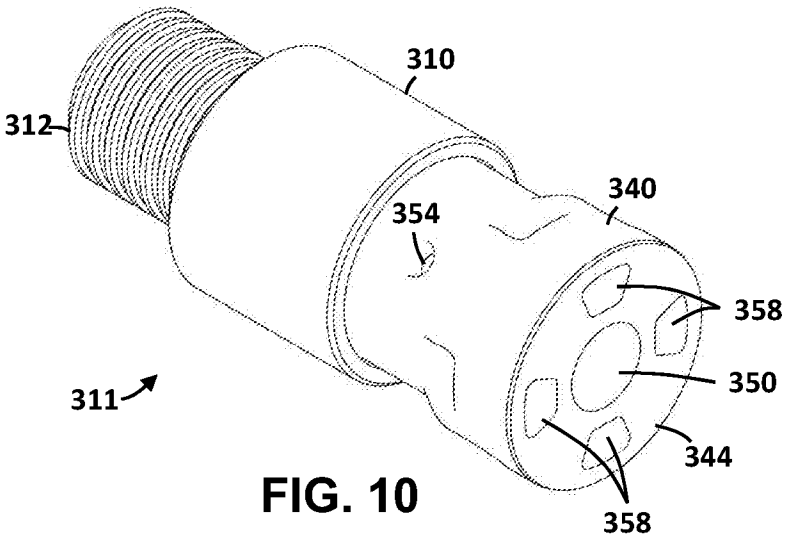
FIG. 10 is perspective view of an oscillating valve used within the valve section of FIG. 4.
Figure 12:
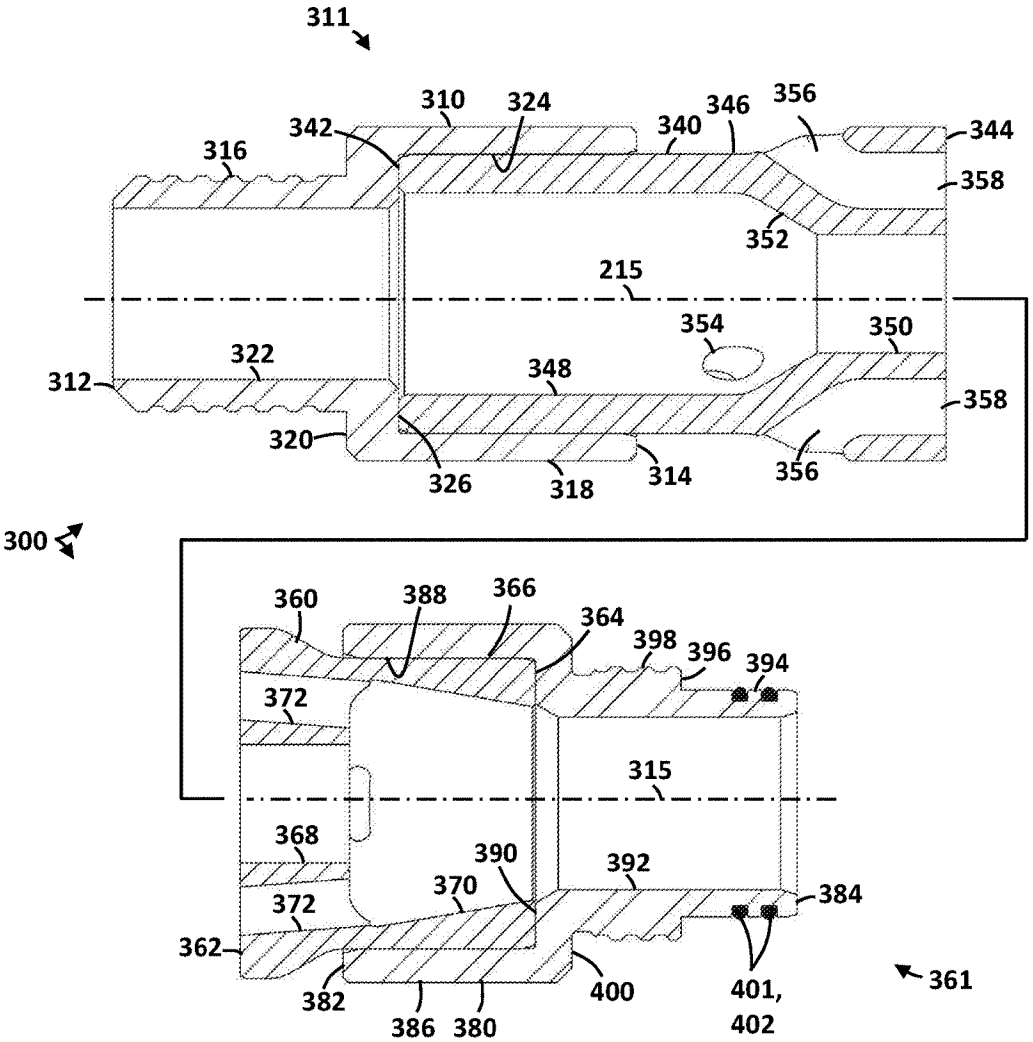
FIG. 12 is a cross-sectional view of the oscillating valve and stationary valve of FIGS. 10 and 11.

Referring to FIGS. 10 and 12, oscillating valve 311 is shown which comprises oscillating valve adapter 310 and oscillating valve port section 340. Generally speaking, oscillating valve port section 340 fits within oscillating valve adapter 310 to form oscillating valve 311. More particularly, oscillating valve adapter 310 comprises a first end 312, a second end 314 opposite first end 312 along axis 215, a coupling surface 316 extending from first end 312, a body 318 extending from second end 314, and an outer shoulder 320 extending radially therebetween. In some embodiments, coupling surface 316 may include threads. Additionally, thru bore 322 extends along axis 215 from first end 312 to meet with a second bore 324 which extends along axis 215 from second end 314. Second bore 324 is a blind hole which terminates within body 318 to form inner shoulder 326.

Oscillating valve port section 340 comprises a first end 342, a second end 344 opposite first end 342 along axis 215, and a body 346 which extends between ends 342, 344. More specifically, body 346 extends from first end 342 with a constant diameter along a first region and then flares into an increased diameter proximate second end 344. Oscillating valve port section 340 further comprises a bore 348 extending along axis 215 from first end 342, which meets with central port 350, which extends along axis 215 from second end 344. Transition 352 is provided between bore 348 and central port 350, and in this embodiment is formed in a frustoconical shape which reduces in diameter proximate second end 344. Orifice 354 is formed as a through hole in body 346, which extends into bore 348 at an angle relative to axis 215. In some embodiments, orifice 354 will be angled towards second end 344 (e.g., with radially inner portions positioned closer to second end 344), with portions of orifice 354 extending along transition 352. Oscillating valve ports 358 extend from second end 344 and include an inlet 356 which extends to a radially outer surface of body 346. In some embodiments, oscillating valve port 358 extends axially relative to axis 215, while inlet 356 extends at an angle towards second end 344 (e.g., with radially inner portions positioned closer to second end 344). As best shown in FIG. 10, a plurality of oscillating valve ports 358 and a plurality of inlets 356 may be provided along second end 344, and may be distributed circumferentially relative to axis 215. For example, in this embodiment, four oscillating valve ports 358 and four inlets 356 are distributed at ninety degree intervals.

To form oscillating valve 311, oscillating valve port section 340 is coupled to oscillating valve adapter 310. More particularly, body 346 of oscillating valve port section 340 is fit within second bore 324 of oscillating valve adapter 310, with first end 342 of oscillating valve port section 340 abutting inner shoulder 326 of oscillating valve adapter 310. In some embodiments, the fit between second bore 324 and body 346 may be a press fit, which requires relative heating between the surfaces during the assembly makeup.

Figure 11:
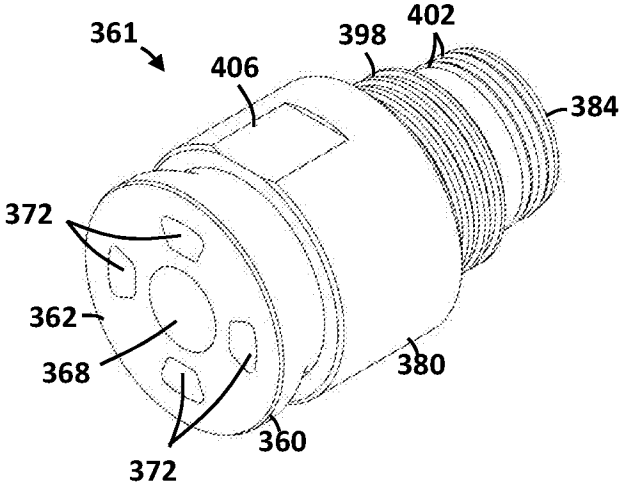
FIG. 11 is perspective view of a stationary valve used within the valve section of FIG. 4.

Referring to FIGS. 11 and 12 stationary valve 361 is shown which comprises stationary valve port section 360 and stationary valve adapter 380. Generally speaking, stationary valve port section 360 fits within stationary valve adapter 380 to form stationary valve 361. More particularly, stationary valve port section 360 comprises a first end 362, a second end 364 opposite first end 322 along axis 315, and a body 366 extending between ends 362, 364. In the embodiment shown, body 366 has a constant diameter section proximate second end 364, and then has an increased diameter along first end 362. Additionally, central port 368 extends within body 366 from first end 362 and meets with taper 370 which extends from second end 364. More specifically, taper 370 has a frustoconical profile which increases in diameter at positions axially away from second end 364. Stationary valve ports 372 are provided along first end 362 at positions offset from axis 315 which are distributed circumferentially relative to axis 315 (as best shown in FIG. 11), and extend into body 366 to meet with the inner cavity formed by taper 370. In this embodiment, four stationary valve ports 372 are provided and are distributed at ninety degree intervals. Stationary valve ports 372 may extend into body 366 in a direction parallel to axis 315 or may extend at an angle. For example, stationary valve ports 372 may converge towards axis 315 at positions proximate to second end 364.

Stationary valve adapter 380 comprises a first end 382, a second end 384 opposite first end 382 along axis 315, a body 386 extending from first end 382, a seal receiving portion 394 extending from second end 384, and a coupling surface 398 extending therebetween. More particularly, body 386, coupling surface 398, and seal receiving portion 394 are each generally cylindrical features, symmetric about axis 315, which are connected with radially oriented shoulders. Shoulder 400 is formed between body 386 and coupling surface 398, while shoulder 396 is formed between coupling surface 398 and seal receiving portion 394. Annular grooves 401 (accepting seals 402) are formed within seal receiving portion 394 proximate to second end 384, and are axially spaced along axis 315. In some embodiments, coupling surface 398 may include threads. Additionally, first bore 388 extends along axis 315 from first end 382 and terminates within body 386 to form inner shoulder 390, while second bore 392 extends along axis 315 from second end 384 to intersect first bore 388.

To form stationary valve 361, stationary valve port section 360 is coupled to stationary valve adapter 380. More particularly, body 366 of stationary valve port section 360 is fit within first bore 388 of stationary valve adapter 380, with second end 364 of stationary valve port section 360 abutting inner shoulder 390 of stationary valve adapter 380. In some embodiments, the fit between first bore 388 and body 366 may be a press fit, which requires relative heating between the surfaces during the assembly makeup.

Referring to FIGS. 4 and 12, valve section 300 houses oscillating valve 311 and stationary valve 361, within bore 33 of housing 30. As previously described generally, valve section 300 includes axis 215, which coincides with the movable rotor 210 and a stationary axis 315 which is concentric with housing 30 and second sub 40. More particularly, oscillating valve 311 is aligned with axis 215 as it couples to rotor 210, while stationary valve 361 is aligned with axis 315 as it couples to second sub 40. In this manner, the offset of axis 215 from axis 315, and any other offset axes, may be referred to as "eccentric," such term also applying to components such as oscillating valve 311 and stationary valve 361 that are axially offset relative to each other. Coupling surface 316 of oscillating valve 311, couples with oscillating valve coupling surface 228 of rotor 210 as second end 214 of rotor 210 abuts with outer shoulder 320 of oscillating valve 311.

Stationary valve 361 fits partially within second sub 40 proximate to first end 41 of second sub 40. More particularly, seals 402 of stationary valve 361 seal along bore 48 of second sub 40, as stationary valve 361 and second sub 40 engage along surfaces 47, 398 and abut along first end 41 and shoulder 400.

The flat faces along second end 344 of oscillating valve 311 and first end 362 of stationary valve 361, abut and generally seal during operations as rotor 210 applies thrust forces along axis 215. Additionally, as rotor 210 rotates within stator 230, the rotor also undergoes a nutating motion, wherein axis 215 moves in an elliptical or orbital pattern relative to axis 315 based on eccentricity of rotor 210 and the interacting lobes 224 and lobe cavities 240. Given this combination of thrust and nutating motion imparted by rotor 210, sliding occurs at the flat abutting faces of valves 311, 361 as the oscillating valve 311 also nutates relative to stationary valve 361. As a shorthand herein, the nutating motion of components within flow pulsing system 10, may alternatively be referred to as "rotating". Additionally, one having ordinary skill in the art will appreciate that the nutating motion may be modified (for example, by varying the dimensions of rotor 210 and stator 230) without departing from the principle of operation disclosed herein. In some embodiments, the path of axis 215 will form a hypocycloid as rotor 210 rotates within stator 230.

Figure 13:
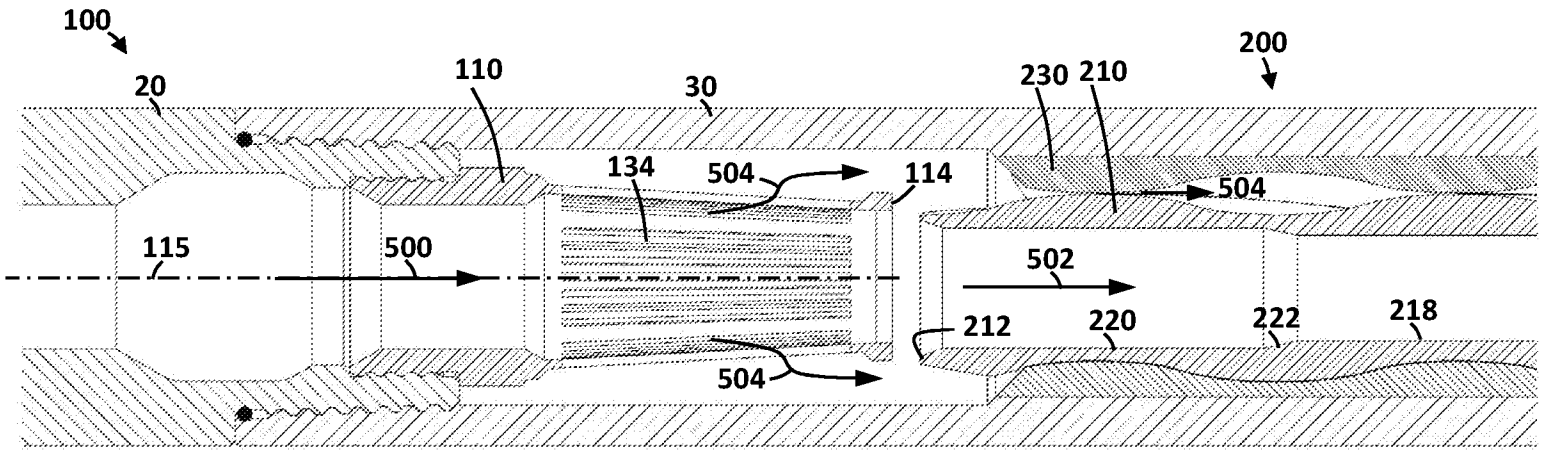
FIG. 13 is a cross-sectional view of the activation section and a partial cross-sectional view of the rotor section, showing fluid flow in the deactivated condition.

Referring to FIG. 13, activation section 100 is shown in a deactivated condition or position, wherein dart 160 is not installed within rotor 210. Generally speaking, in the deactivated condition, rotor 210 is only slowly rotating within stator 230, and as a result, flow pulsing system 10 may only produce a small amount of pulsating flow.

During drilling operations, drilling mud may be introduced within the bore or annulus of a drill string (not shown) and impart upstream flow 500 which extends from first sub 20 into activation section 100. Upstream flow 500 flows generally along axis 115 and thus tends to continue this flow direction through screen 110 and pass largely as bore flow 502 into bore 218 within rotor 210. Due to limited flow restrictions downstream of bore flow 502, relatively small back pressures occur that impede bore flow 502, and in general, this deactivated condition may results in only 20 to 80 psi in pressure losses passing thorough flow pulsing system 10 overall. Under some flow conditions, backpressure within bore 218 of rotor 210 may occur which will bias some annulus flow 504 through screen elements 134 of screen 110. Annulus flow 504 then progresses downstream moving between rotor 210 and stator 230, thereby causing some rotation of rotor 210, even in the deactivated condition. The gap between screen 110 and rotor 210 is shown exaggerated for clarity, and may in application approach abutting contact, such that any annulus flow 504 will pass through screen elements 134. This configuration may be helpful in preventing particulate clogging between rotor 210 and stator 230. For example, loss circulation materials within upstream flow 500, will tend to be directed into bore 218, and away from the relatively smaller passages between rotor 210 and stator 230. Additionally, the tapered shape of screen housing 120 may tend to prevent clogging of screen elements 134, and may in effect be "self-cleaning". Also, the close positioning of screen 110 may offer an additional operational benefit for rotor section 200, as rotor 210 may be constrained from axial motion as second end 114 of screen 110 abuts first end 212 of rotor 210. During some flow conditions, rotor 210 may tend to "kick back" and thus apply thrust forces against screen 110, even when screen 110 is configured to maintain a clearance gap between ends 114, 212.

Figure 14:
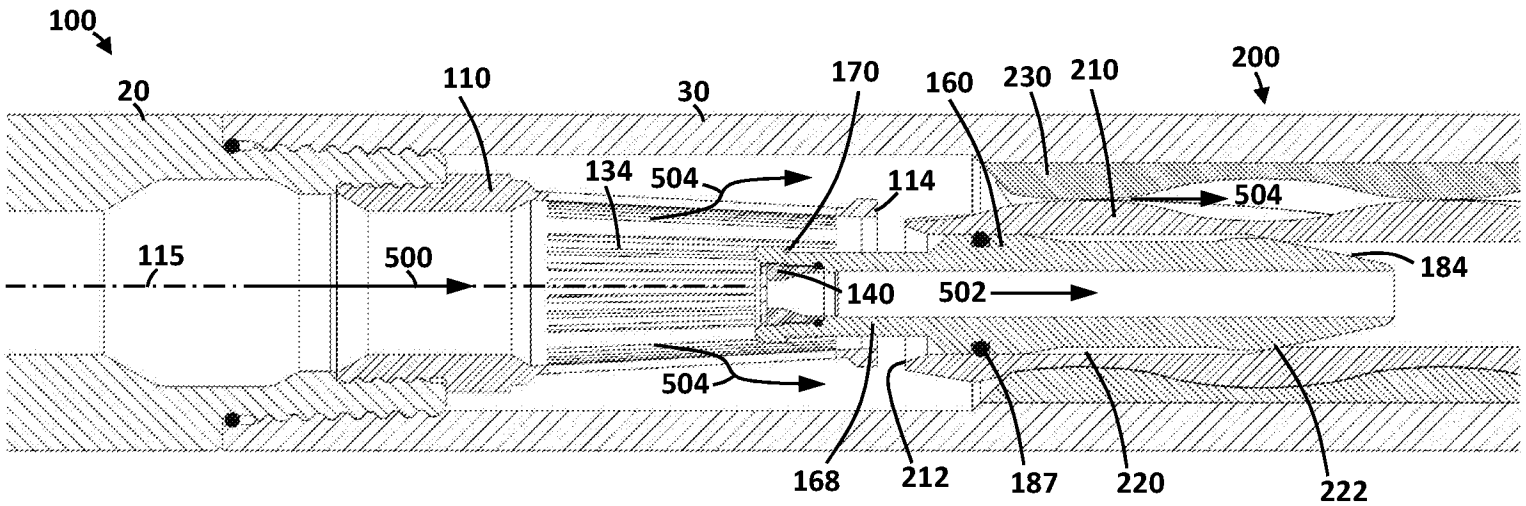
FIG. 14 is a cross-sectional view of the activation section and a partial cross-sectional view of the rotor section, showing fluid flow therethrough in an activated condition.

Referring to FIG. 14, activation section 100 is shown in an activated condition or position, wherein dart 160 is installed within rotor 210. In the activated condition, additional upstream flow 500 is directed to annulus flow 504 to impart increased rotation of rotor 210, which causes flow pulsing system 10 to produce an increased pulsing flow. The pulsing frequency and magnitude are related to the flow rate of annulus flow 504, which is controllable in part by selecting a particular nozzle 140 for dart 160. More particularly, when dart 160 is mated along seat 222 of rotor 210, ring 187 may seal along second bore 220 of rotor 210, and substantially all bore flow 502 through rotor 210, will pass through nozzle 140, and the back pressure (e.g., head loss or pressure drop through nozzle 140) will then drive larger annulus flow 504, which spins rotor 210 at a higher frequency. By providing a variety of nozzle 140 configurations, users of flow pulsing system 10 are able to select a flow pulsing frequency and magnitude which are appropriate for the specific downhole conditions once the drill string is already in position within a partially drilled wellbore. Because the overall pressure losses through flow pulsing system 10 tend to increase with increased annulus flow 504, users of flow pulsing system 10 may select a nozzle 140 with an inner nozzle profile 150 (as shown in FIG. 8) that optimizes the flow pulsing frequency and amplitude while balancing the overall pressure drop across flow pulsing system 10. Additionally, the diameter of orifice 354 (FIG. 12) and the drilling mud composition (e.g. weight and viscosity) may also be varied to influence the pulsing frequency and amplitude. This ability to balance the flow pulsing system 10 performance against the associated pressure drop may be advantageous during operations, as the exact flow pulsing frequency and amplitude needed may not be known or predicable ahead of drilling operations. Additionally, even if the user did prospectively know what frequency and amplitude was going to be needed, the on/off selectability may allow the users to only engage flow pulsing system 10 once it is needed, and thus preserving the pumping pressure requirements from the surface equipment on the drilling rig.

Additionally, activation section 100 may be returned to the deactivated condition, as shown in FIG. 13, as dart 160 may be selectably disengaged from seat 222 of rotor 210. More particularly, a separate tool (e.g., a wireline tool or puller, not shown) may be used to grip dart 160 along shoulder 170 and/or neck 168 and apply tensile forces to retrieve dart 160. In some embodiments, a close proximity between first end 212 of rotor 210 and second end 114 of screen 110 may be advantageous, as abutting contact therebetween may compressively resist the tensile forces applied to dart 160. After retrieval of dart 160, drilling operations may continue without operating flow pulsing system 10, thus reducing the overall pressure drop across flow pulsing system 10, or nozzle 140 of dart 160 may be reconfigured to select a different flow pulsing frequency or magnitude than what was initially used. This sequential retrieval and reconfiguring of dart 160 may be repeated as necessary during the drilling operations.

Figure 15:
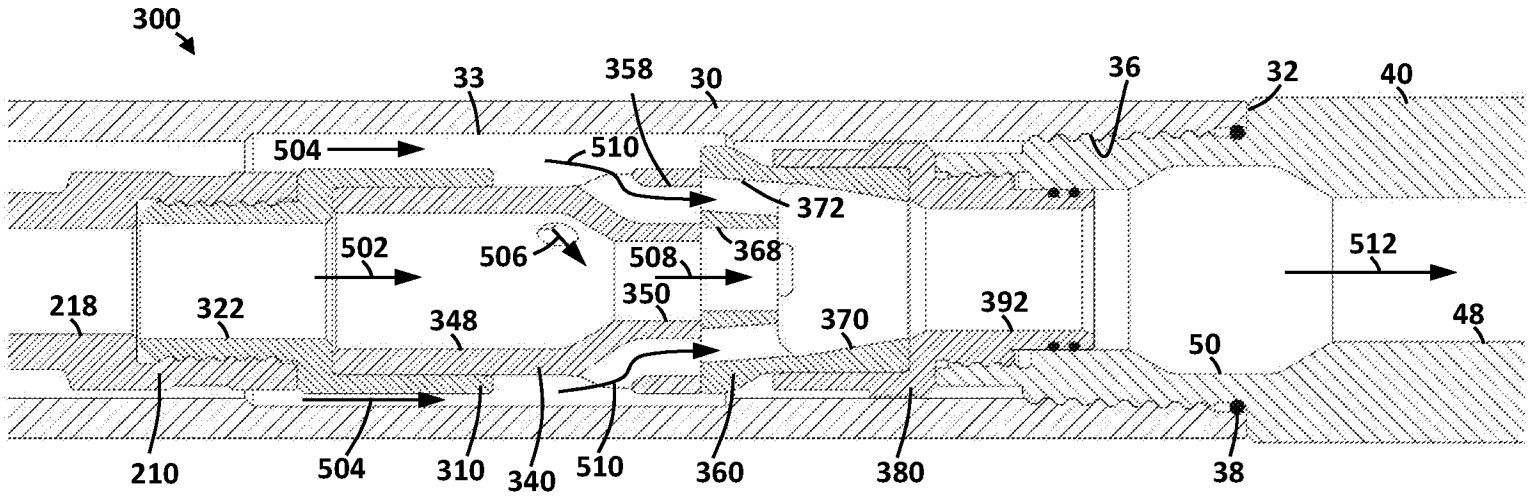
FIG. 15 is a cross-sectional view of the valve section of FIG. 4, showing fluid flow therethrough.

Referring to FIG. 15, valve section 300 is shown in a deactivated condition, wherein dart 160 is not installed within rotor 210. As previously described, in the deactivated condition, bore flow 502 is greater than annulus flow 504, thus most of the total upstream flow 500 is directed between central ports 350, 368, which may be configured to produce only small pulsing flows. More particularly, central port flow 508 is defined between central ports 350, 368 of oscillating valve port section 340 and stationary valve port section 360, respectively. Valve port flow 510 is defined between oscillating valve ports 358 and stationary valve ports 372. Downstream flow 512 is defined as the flow exiting stationary valve adapter 380 and entering into second sub 40 and comprises the summation of flows 508, 510. Flow 506 is also shown passing through orifice 354, which in some flow configurations, may provide a flow path between bore flow 502 and annulus flow 504. For example, as will be discussed more fully below, when nozzle 140 is directing flow to annulus flow 504 while a blockage exists between ports 358, 372 that restricts or fully blocks valve port flow 510.

Figure 18:
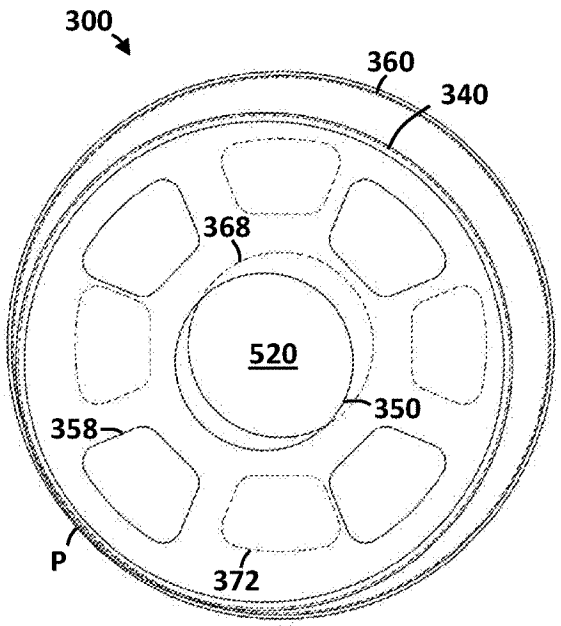
FIG. 18 is another schematic axial view of the oscillating valve and stationary valve interface, showing the overlap of ports in a closed condition.
Figure 17:
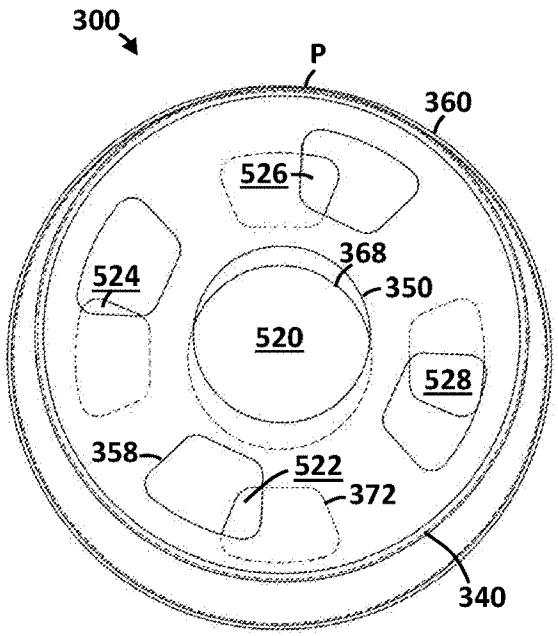
FIG. 17 is another schematic axial view of the oscillating valve and stationary valve interface, showing the overlap of ports in a partially open condition.
Figure 16:
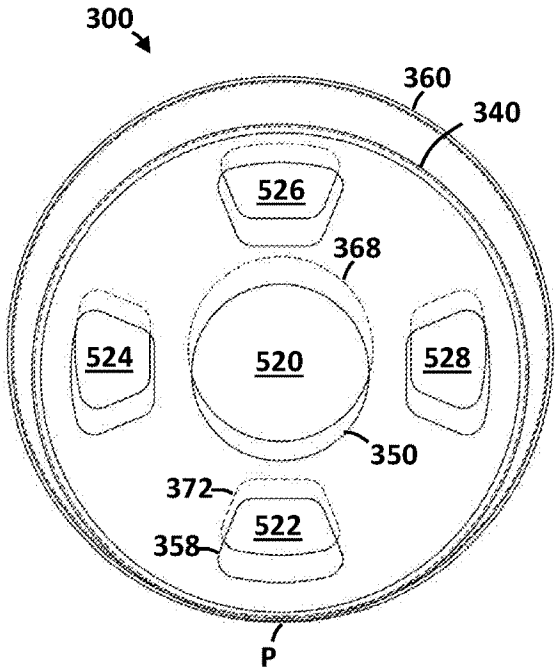
FIG. 16 is a schematic axial view of the oscillating valve and stationary valve interface, showing the overlap of ports in an open condition.

Referring to FIGS. 16-18, an axial view aligned with axis 315 is shown to illustrate the relative positions of oscillating valve port section 340 and stationary valve port section 360. More specifically, each figure shows the port positions along the abutting faces of sections 340, 360 to illustrate the valve overlaps as oscillating valve port section 340 nutates with rotor 210 relative to the stationary position of stationary valve port section 360. Also, point P shows where sections 340, 360 contact, or most closely approach contact in each oscillating valve port section 340 position. Central port overlap 520 is defined as the open passage between central ports 350, 368, while first port overlap 522, second port overlap 524, third port overlap 526, and fourth port overlap 528 are defined between the plurality of oscillating valve ports 358 and stationary valve ports 372. As shown in FIG. 16, the areas between port overlaps 522, 524, 526, 528 may not be equal in some arrangements of ports 358, 372, and the relative magnitude of areas of port overlaps 522, 524, 526, 528 may vary as a function of oscillating valve port section 340 position, as shown for example in FIG. 17. Overall, the summation of areas of port overlaps 522, 524, 526, 528 influences valve port flow 510 (as shown in FIG. 15), while the area of central port overlap 520 influences central port flow 508 (as shown in FIG. 15). Together, the change of port overlaps 522, 524, 526, 528 and central port overlap 520, with respect to rotor 210 position (e.g., with respect to time) creates periodic flow pressure pulses in downstream flow 512. FIG. 16 shows a position having a maximum total area for port overlaps 522, 524, 526, 528, which may alternatively be referred to a "fully open position" of valve section 300. FIG. 17 shows a "partially open position" of valve section 300, wherein the total area for port overlaps 522, 524, 526, 528 is less than the maximum total area of the fully open position. FIG. 18 shows a "fully closed position" of valve section 300, wherein no port overlaps 522, 524, 526, 528 are present.

Referring to FIGS. 15-18, in the deactivated condition, wherein dart 160 is not installed within rotor 210, bore flow 502 is greater than annulus flow 504 and thus central port flow 508 through central port overlap 520 is greater than valve port flow 510 through port overlaps 522, 524, 526, 528. Despite comparable flow areas for central port flow 508 and valve port flow 510 through valve section 300 in some embodiments, central port flow 508 will still be larger than valve port flow 510 in the deactivated condition as annulus flow 504 has a higher pressure drop along rotor section 200 than does bore flow 502. A small annulus flow 504 results in only slight rotor 210 rotation, only slight variations in central port overlap 520, and thus only slight pressure pulses in downstream flow 512. Additionally, in some embodiments, even with rotor 210 rotation, central port overlap may be configured to have little or no area change with respect to rotor position. Flow 506 may also pass out of bore 348 and contribute to valve port flow 510, however, this flow will still not produce flow pulses, as this "bypass" flow will not rotate rotor 210, and thus will not vary port overlaps 522, 524, 526, 528.

Referring still to FIGS. 15-18, after activation section 100 is in the activated condition, with dart 160 installed within rotor 210, annulus flow 504 is increased relative to the deactivated condition. Annulus flow 504 leads to valve port flow 510 and intermittently diverts to flow 506 as port overlaps 522, 524, 526, 528 reduce in area. The diameter of orifice 354 may be adjusted to provide the appropriate "bypass" flow and in some embodiments, orifice 354 may be fully omitted. As previously described, the magnitude of bore flow 502 depends on nozzle 140 selection and in some configurations may still be large as compared to annulus flow 504, thus central port flow 508 will also be comparatively large. In this configuration, central port overlap 520 may or may not contribute to the pressure pulses, depending on the relative sizes and positions of central ports 350, 368.

In the manner described, embodiments disclosed herein include systems and methods for using a flow pulsing system which may be selectively engaged after wellbore drilling has begun, and while the drilling string remains disposed within the wellbore. Additionally, systems and methods disclosed herein allow selective adjustability of the flow pulsing system frequency and magnitude, as well as systems and methods to selectively disengage and/or reconfigure the frequency and magnitude, while the flow pulsating system remains disposed within the wellbore. In this manner, the overall pressure loss through flow pulsing system 10 may be selectively controlled. Further, systems and methods disclosed herein provide valve ports which may be operated between a fully open, a partially open, and a fully closed position which may provide an improved pressure pulse response. As the valve port sections 340, 360 cycle through the open, partially open, and closed positions the oscillating valve portion section 340 nutates relative to the stationary valve port section 360. Still further, systems and methods disclosed herein resist clogging of the flow pulsing system when materials are introduced into the wellbore, such as loss circulation materials or diverter.

While exemplary embodiments have been shown and described, modifications thereof can be made by one skilled in the art without departing from the scope or teachings herein. For example it is anticipated that screen 110 may have different shapes along screen housing 120 which are non-conical. Additionally, screen elements 134 may be modified to comprise a plurality of thru holes such has circular through holes oriented radially. It is also anticipated that dart 160 may seal with rotor 210 with a different combination of bore sealing rings, such as ring 187, or may use face sealing rings between abutting annular shoulders. Such abutting shoulders may also be included to prevent or control the degree of taper locking between tip 184 and seat 222. Additionally, it is anticipated that flow pulsing system 10 may be provided in a constantly activated condition wherein dart 160 and nozzle 140 are not removable from bore 218 of rotor 210. For example, such embodiments may be produced by welding dart 160 to rotor 210 or alternatively by omitting dart 160 and coupling nozzle 140 directly with rotor 210. Nozzle 140 may thus also be coupled irremovably with rotor 210 (e.g. welded) or may be produced as portion of rotor 210. Alternative shapes and arrangements of ports within oscillating valve 311 and stationary valve 361 are anticipated, as the diameter of orifice 354 and the overlaps, such as central port overlap 520 and overlaps 522, 524, 526, 528, will control the "shape" of the pressure pulse produced on an amplitude verses time plot. For example a port overlap having a large rate of change with respect to time, may produce a pressure pulse shape which approaches a square wave, also having a large rate of change with respect to time, while port overlaps which vary more slowly may produce a pressure pulse shape which is more gradually varying. These pressure pulse shapes may thus be tailored to maximize shock tool performance, while also optimizing stresses imparted to pumping equipment and to mechanical components within the drilling string. Additionally, the ports within oscillating valve 311 and/or stationary valve 361 may be omitted, for example if a lobed outer profile is used, as the spaces between lobes could serve as ports. Thus, the embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A flow pulsing system comprising:

a housing having a central axis, a first end, a second end opposite the first end, and a bore extending along the central axis from the first end to the second end;

a stator disposed within the bore of the housing having a plurality of lobe cavities;

a rotor disposed within the stator, the rotor comprising:

an axis offset from the central axis;

a plurality of lobes that mate with the plurality of lobe cavities; and a thru bore extending along the axis; and a valve section comprising:

a stationary valve coupled to the second end of the housing, the stationary valve comprising a first face, a stationary central port aligned with the central axis, and a plurality of stationary valve ports;

an oscillating valve coupled to the rotor, the oscillating valve comprising a second face abutting the first face, an oscillating central port aligned with the axis of the rotor and in fluid communication with the thru bore of the rotor, and a plurality of oscillating valve ports in fluid communication with the plurality of lobe cavities.

2. The flow pulsing system of claim 1, wherein the position of the oscillating valve relative to the stationary valve creates:

a central port overlap between the central port of the stationary valve and the central port of the oscillating valve; and a first port overlap between one of the plurality of stationary valve ports and one of the plurality of oscillating valve ports, wherein the motion of the rotor varies the first port overlap between a fully open position and a fully closed position.

3. The flow pulsing system of claim 2, further including a second port overlap between another one of the plurality of stationary valve ports and another one of the plurality of oscillating valve ports, wherein the first port overlap and second port overlap have different areas at an intermediate position of the rotor, the intermediate position occurring between the fully open and the fully closed position.

4. The flow pulsing system of claim 1, wherein the rotor is moveable to move the oscillating valve relative to the stationary valve.

5. The flow pulsing system of claim 4, wherein rotor motion causes a nutating motion of the oscillating valve relative to the stationary valve.

6. The flow pulsing system of claim 4, wherein rotor motion causes an eccentric motion of the oscillating valve relative to the stationary valve.

7. The flow pulsing system of claim 6, wherein the oscillating central port and the oscillating valve ports rotate eccentrically relative to the stationary central port and the stationary valve ports.

8. A flow pulsing system comprising:

a housing having a central axis, a first end, a second end opposite the first end, and a bore extending along the central axis from the first end to the second end;

a stator disposed within the bore of the housing having a plurality of lobe cavities;

a rotor disposed within the stator, the rotor comprising:

an axis offset from the central axis;

a plurality of lobes that mate with the plurality of lobe cavities; and a thru bore extending along the axis;

a valve section comprising:

a stationary valve coupled to the second end of the housing, the stationary valve comprising a first face, a stationary central port, and a plurality of stationary valve ports; and an oscillating valve coupled to the rotor, the oscillating valve comprising a second face abutting the first face, an oscillating central port in fluid communication with the thru bore of the rotor, and a plurality of oscillating valve ports in fluid communication with the plurality of lobe cavities;

a releasable nozzle coupled to the rotor and configured to control a first fluid flow through the thru bore of the rotor; and a dart configured to releasably couple with a seat within the thru bore of the rotor, the dart including an inner coupling surface along an inner bore which threadably couples with the releasable nozzle coupled to the rotor;

wherein the releasable nozzle is configured to control a second fluid flow along a path between the plurality of lobe cavities of the stator and the plurality of lobes along the rotor.

9. A flow pulsing system comprising:

a housing having a central axis, a first end, a second end opposite the first end, and a bore extending along the central axis from the first end to the second end;

a stator disposed within the bore of the housing having a plurality of lobe cavities;

a rotor disposed within the stator, the rotor comprising:

an axis offset from the central axis;

a plurality of lobes that mate with the plurality of lobe cavities; and a thru bore extending along the axis; and a valve section comprising:

a stationary valve coupled to the second end of the housing, the stationary valve comprising a first face, a stationary central port, and a plurality of stationary valve ports;

an adapter comprising a body and an outer surface;

an oscillating valve coupled to the rotor by the adapter disposed between the oscillating valve and the rotor, the oscillating valve comprising a body with a radially outer surface, a second face abutting the first face, an oscillating central port in fluid communication with the thru bore of the rotor, and a plurality of oscillating valve ports in fluid communication with the plurality of lobe cavities through an inlet disposed in the radially outer surface of the oscillating valve body.

10. The flow pulsing system of claim 9, wherein a position of the oscillating valve relative to the stationary valve creates:

a central port overlap between the central port of the stationary valve and the central port of the oscillating valve; and a first port overlap between one of the plurality of stationary valve ports and one of the plurality of oscillating valve ports, wherein motion of the rotor varies the first port overlap between a fully open position and a fully closed position.

11. The flow pulsing system of claim 10, further including a second port overlap between another one of the plurality of stationary valve ports and another one of the plurality of oscillating valve ports, wherein the first port overlap and second port overlap have different areas at an intermediate position of the rotor, the intermediate position occurring between the fully open and the fully closed position.

12. The flow pulsing system of claim 9, wherein the rotor is moveable to move the oscillating valve relative to the stationary valve.

13. The flow pulsing system of claim 12, wherein rotor motion causes a nutating motion of the oscillating valve relative to the stationary valve.

14. The flow pulsing system of claim 12, wherein rotor motion causes an eccentric motion of the oscillating valve relative to the stationary valve.

15. The flow pulsing system of claim 14, wherein the oscillating central port and the oscillating valve ports rotate eccentrically relative to the stationary central port and the stationary valve ports.

16. The flow pulsing system of claim 9, further comprising a releasable nozzle coupled to the rotor and configured to control a first fluid flow through the thru bore of the rotor.

17. The flow pulsing system of claim 16, further comprising a dart which is configured to releasably couple with a seat within the thru bore of the rotor, the dart including an inner coupling surface along an inner bore which threadably couples with the releasable nozzle;

wherein the releasable nozzle is further configured to control a second fluid flow along a path between the plurality of lobe cavities of the stator and the plurality of lobes along the rotor.

* * * * *